US006062934A

United States Patent [19]

Yamaguchi et al.

[11] Patent Number: 6,062,934

[45] Date of Patent: May 16, 2000

[54] JIG FOR ALIGNING/FIXING OXIDE CATHODE AND METHOD OF FABRICATION OXIDE CATHODES USING THE SAME

[75] Inventors: Hiroshi Yamaguchi; Kiyoshi Saitoh; Riichi Kondo; Takashi Shinjo, all of Tokyo, Japan

[73] Assignee: Mitsubishi Denki Kabushiki Kaisha, Tokyo, Japan

[21] Appl. No.: 09/352,365

[22] Filed: Jul. 13, 1999

[30] Foreign Application Priority Data

Oct. 28, 1998 [JP] Japan ..... 10-307540

[51] Int. Cl.[7] ..... H01J 9/02

[52] U.S. Cl. ..... 445/51; 118/500

[58] Field of Search ..... 118/500; 445/58

[56] References Cited

U.S. PATENT DOCUMENTS 5,067,433 11/1991 Doll, Jr. et al. ..... 118/500

FOREIGN PATENT DOCUMENTS 53-85148 7/1978 Japan .

*Primary Examiner*—Kenneth J. Ramsey

[57] ABSTRACT

A large number of oxide cathodes are aligned in an oxide cathode aligning/fixing jig which is formed in a plate shape composed of an upper member and lower member. The horizontal positions of the oxide cathodes fit in the cut holes are fixed by the upper member. The height of the upper surface of the metallic body of each of the oxide cathodes, on which a carbonate paste is to be printed is fixed by the lower member of the jig. By performing the screen printing for the metallic bodies in a state where the upper surfaces thereon are at equal heights, misalignment in printing pattern or variation in the thickness of the printed carbonate films can be suppressed. Thus, the screen printing can be carried out for the large number of oxide cathodes at a time at precise positions and with a uniform thickness of the carbonate layer.

18 Claims, 13 Drawing Sheets

JIG FOR ALIGNING/FIXING OXIDE CATHODE AND METHOD OF FABRICATION OXIDE CATHODES USING THE SAME

BACKGROUND OF THE INVENTION

1. Field of the Invention

The present invention relates to fabrication of an oxide cathode or hanging-type oxide cathode used in an electron tube such as CRT, and more particularly to a jig for aligning/fixing the oxide cathode when screen-printing is carried out for applying a carbonate layer in the process of fabricating the oxide cathode, and a method of fabricating the oxide cathode using the jig.

2. Description of the Related Art

A previously known method of fabricating an oxide cathode is disclosed in JP-A-53-85418. This reference discloses a technique of subjecting the upper surface of a cathode body of a cathode for an electron tube to screen-printing to form a coarse Ni face of Ni paste and apply a carbonate layer after sintering. This technique, which can increase the surface area of the Ni coarse surface and adhesive force, realizes a cathode for an electron tube with stable quality.

Actually, when carbonate paste is applied on the metallic body of the oxide cathode by screen printing to form a carbonate layer, with a plurality of oxide cathodes being aligned, the carbonate paste can be simultaneously applied on the metallic body of each oxide cathode through a squeezing operation. The thickness of the carbonate paste applied by the screen printing influences the several characteristics of an electron tube, and hence a very important item to be managed in mass production of the oxide cathode. Therefore, it is desired that the carbonate layer of each of the oxide cathodes mass-produced has a required equal thickness. It is also desired that redundant carbonate paste does not flow onto the cylindrical sleeve side to which the metallic body is welded, and the sleeve or metallic body does not deform owing to load which necessarily occurs in contact of the oxide cathode with a screen during printing.

In order to solve these problems, it is required that the oxide cathodes to be subjected to printing are arranged so that the upper surface of the metallic body of each oxide cathode is in parallel to and uniformly apart from the screen. It is also required that the position of each metallic body is precisely aligned with the individual printing pattern of the screen. Therefore, it is necessary to use a jig which permits the upper position of the metallic body to be precisely located for the individual oxide cathode in its vertical, horizontal and twisting directions. In order to prevent the deformation of the sleeve or metallic body, a portion for supporting the screen so as to be flush with the metallic body must be installed within the jig.

An object of the present invention is to provide an oxide cathode aligning/fixing jig which permits a carbonate layer to be simultaneously applied on the upper surface of a metallic body of each of a large number of oxide cathodes by screen printing, thus improving the mass production efficiency and permits the oxide cathodes to be located precisely and easily to prevent and correct the deformation of the oxide cathodes.

Another object of the present invention is to provide a method of fabricating a plurality of oxide cathodes using the jig.

A first aspect is an oxide cathode aligning/fixing jig in which a plurality of oxide cathodes, each having a metallic body on an upper surface of which a screen-printing layer is to be applied, are aligned/fixed at regular intervals in a state where the upper surface of the metallic body is oriented upward.

A second aspect is an oxide cathode aligning/fixing jig according to the first aspect, wherein the upper surfaces of the metallic bodies are made flush with one another.

A third aspect is an oxide cathode aligning/fixing jig according to the second aspect, wherein each of said oxide cathodes is fixed at its bottom.

A fourth aspect is an oxide cathode aligning/fixing jig according to the third aspect, wherein each of said oxide cathode is fixed at its side.

A fifth aspect is an oxide cathode aligning/fixing jig according to the first aspect, wherein said plurality of oxide cathodes each includes a metallic body on an upper surface of which an electron radiative material layer is to be formed by screen-printing.

A sixth aspect is an oxide cathode aligning/fixing jig according to the first aspect, wherein said plurality of oxide cathodes each includes a metallic body on an upper surface of which a carbonate layer is to be formed by screen-printing.

A seventh aspect is an oxide cathode aligning/fixing jig according to the sixth aspect, wherein the upper surfaces of the metallic bodies are flush with one another.

An eighth aspect is an oxide cathode aligning/fixing jig according to the first aspect, wherein each said oxide cathodes is a hanging-type oxide cathode including a cylindrical sleeve at one end of which the metallic body is secured and an eyelet which surrounds a portion of the outer surface inclusive of the other end of said sleeve so as to protrude the metallic body and fixedly hangs said sleeve through a ribbon; and wherein said oxide cathode aligning/fixing jig includes

- a plate-like upper fixing jig which have through-holes formed at regular intervals and fixedly supports the outer surface of said eyelet, the diameter of each said through-holes corresponding to the diameter of the eyelet; and
- a plate-like lower fixing jig which has sleeve bottom supporting members arranged to correspond to said through-holes in their position and fixedly supports the bottom of said sleeve, each said sleeve bottom supporting members being a cylinder having a diameter smaller than that of the eyelet and larger than that of said sleeve.

A ninth aspect is an oxide cathode aligning/fixing jig according to the eighth aspect, wherein each said oxide cathodes is a hanging-type oxide cathode including a cylindrical sleeve at one end of which the metallic body is secured and an eyelet which surrounds a portion of the outer surface inclusive of the other end of said sleeve so as to protrude the metallic body and fixedly hangs said sleeve through a ribbon; and Wherein said oxide cathode aligning/fixing jig includes

- a plate-like upper fixing jig which have through-holes formed at regular intervals and fixedly supports the outer surface of said eyelet, the diameter of each said holes corresponding to the diameter of the eyelet; and
- a lower fixing jig having cylinders each of which is structured to support the bottom of each said metallic bodies and internal surface of said sleeve, and has an end surface in contact with the bottom of each said metallic bodies having a smaller diameter than that of the other end surface.

A tenth aspect is an oxide cathode aligning/fixing jig according to the first aspect, wherein each said oxide cathodes is composed of a metallic body and a sleeve with said metallic body secured to its one end, wherein said oxide cathode aligning/fixing jig includes a plate-like upper fixing jig which have through-holes formed at regular intervals and fixedly supports the outer surface of said eyelet, the diameter of each said through-holes corresponding to the maximum diameter of said sleeve; and a plate-like lower fixing jig which has cylinders arranged to correspond to said through-holes in their position and fixedly supports the bottom of said metallic body and the internal surface of said sleeve.

An eleventh aspect is an oxide cathode aligning/fixing jig according to the eighth aspect, wherein said sleeve bottom supporting members or cylinders of said lower fixing jig each has a sweeping hole at a position in contact with the bottom of said sleeve or metallic body.

A twelfth aspect is an oxide cathode aligning/fixing jig according to the eighth aspect, wherein said upper fixing jig is structured to protrude toward the center of the through-hole so that each said through-holes of said upper fixing jig has a smaller diameter at a portion in the vicinity of the metallic body when said oxide cathode is installed than the remaining portion, thereby constituting a sleeve side supporting member.

A thirteenth aspect is an oxide cathode aligning/fixing jig according to the eighth aspect, wherein the upper surface of said upper fixing jig is flush with that of said metallic body when each said oxide cathodes is arranged.

A fourteenth aspect is an oxide cathode aligning/fixing jig according to the twelfth aspect, wherein a depression is formed on the upper surface of said fixing jig corresponding to the end of said sleeve side supporting member, or a taper is formed downward toward the end of said sleeve side supporting member.

A fifteenth aspect is an oxide cathode aligning/fixing jig according to the fourteenth aspect, wherein said depression or taper has a size enough to prevent paste layer formed by screen-film printing from being applied to the side of said sleeve by the capillary action.

A sixteenth aspect is an oxide cathode aligning/fixing jig according to the twelfth aspect, wherein said sleeve side supporting member is formed to provide a minute gap between itself and the sleeve when said oxide cathode is installed.

A seventeenth aspect is an oxide cathode aligning/fixing jig according to the sixteenth aspect, wherein said minute gap has a size enough to prevent paste layer formed by screen-printing from being applied to the side of said sleeve by the capillary action.

An eighteenth aspect is a method of fabricating a plurality of oxide cathodes with a carbonate layer applied thereon using the oxide cathode aligning fixing jig according to the eighth aspect, which comprises the steps of:

aligning and fixing said plurality of the metallic body for the oxide cathodes in said aligning/fixing jig so as to expose the upper surface of said metallic body;

screen-printing carbonate paste on the upper surface of said metallic body by screen printing; and drying and baking said plurality of oxide cathodes.

By using the oxide cathode aligning/fixing jig according to the present invention, the metallic bodies of a plurality of oxide cathodes can be aligned at equal heights, and the vertical and horizontal positions of the oxide cathodes can be secured precisely. For this reason, when the carbonate paste is applied by the screen printing, a carbonate layer having a uniform thickness can be obtained with a suppressed variation in printing pattern(thick film). Since the carbonate layer can be applied for a large number of oxide cathodes at a time, the mass-production efficiency can be increased.

By using the oxide cathode aligning/fixing jig according to the present invention, in addition to the above advantage, during the process of fabricating the hanging-type oxide cathode, the displacement between sleeve and eyelet due to the deformation of the ribbon can be corrected.

When the oxide cathode aligning/fixing jig according to the present invention is used, the upper surface of the upper member of this jig is adjusted to be flush with the upper surface of the metallic body on which the carbonate paste is applied when the oxide cathode is installed. In the case where the printing is carried out with a squeeze being pressed downward, the force applied to the metallic body can be dispersed, thus deforming the oxide cathode.

By using the oxide cathode aligning/fixing jig according to the present invention, in which a depression, taper or spot-facing is formed at a position corresponding to a sleeve supporting of the edge of the cut-hole on the surface of the upper fixing jig, it is possible to suppress the flow of the carbonate paste to the sleeve side by the capillary action when the carbonate paste is screen-printed.

By fabricating the oxide cathodes using the oxide cathode aligning/fixing jig described above, the carbonate layer having a uniform thickness can be formed for a large number of oxide cathodes at a time, and the positioning accuracy in printing can be also improved.

The above and other objects and features of the present invention will be more apparent from the following description taken in conjunction with the accompanying drawings.

DESCRIPTION OF THE PREFERRED EMBODIMENTS

Embodiment 1

Figure 1A:
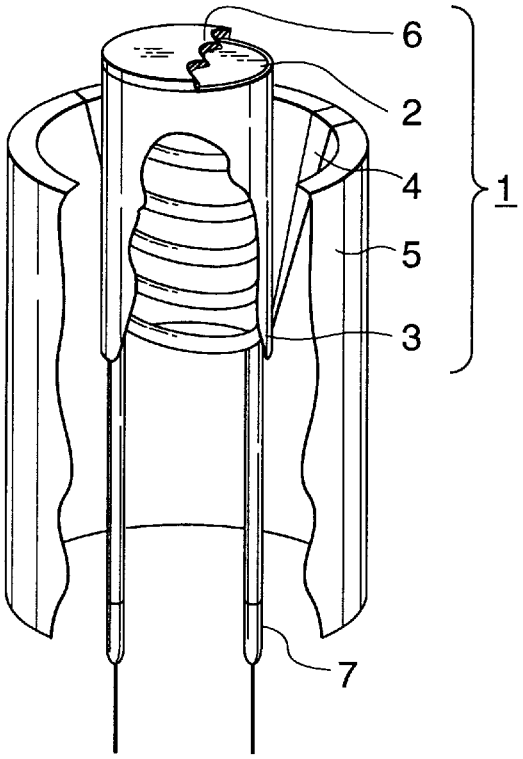
FIGS. 1A and 1B are perspective views of a general hanging-type oxide cathode structure.

Now referring to FIG. 1A, an explanation will be given of the structure of a general hanging-type oxide cathode and an example of its assembly. A hanging-type oxide cathode, denoted by generally, reference numeral 1, is used for an electron tube such as CRT.

The hanging-type cathode 1 includes a metallic body 2 having at least one plane, a hollow cylindrical sleeve 3 which is formed a long the edge of the plane of the metallic body 2 and extends unidirectionally and a cylindrical eyelet 5 arranged concentrically with the sleeve 3 so as to surround at least a part thereof. The sleeve 3 and the eyelet 5 are fixedly coupled with each other by means of a ribbon 4. A carbonate layer 6 is formed on the upper surface of the metallic body 2. Within the sleeve 3, a heater 7 is arranged which is partially formed in a spiral shape.

In the structure described above, the metallic body 2, which is formed in a disk shape, has a diameter of 1–2 mm, and a thickness of 100–200 $\mu$m. The metallic body 2 is mainly made of Ni, and contains reductive metal element such as Si, Mg, etc. The sleeve 3, which is formed in a hollow pipe shape, has an inner generally has a thickness of several hundreds $\mu$m taking into consideration shortening the time required to heat the oxide cathode and evaporation due to heating from the view point of practical use. The sleeve 3 and the metallic body 2 are fixedly coupled with each other by laser welding.

The ribbon 4 which couples the sleeve 3 with the eyelet 5 is made of e.g. substance of the sleeve 3 and has a thickness approximately equal to that of the sleeve 3. The ribbon is bent at both ends to couple the sleeve 3 with the eyelet 5. The coupling therebetween is performed by e.g. laser welding or resistive welding. The eyelet 5 is made of the hard substance such as an cobalt alloy in order to prevent the deformation of the eyelet 5. In order to heat the oxide cathode, generally, the heater 7 is installed within the sleeve 3. The shape of the hanging-type oxide cathode 1 intends to shorten the time required to reach the operating temperature of the cathode and to improve the heat efficiency.

Figure 1B:
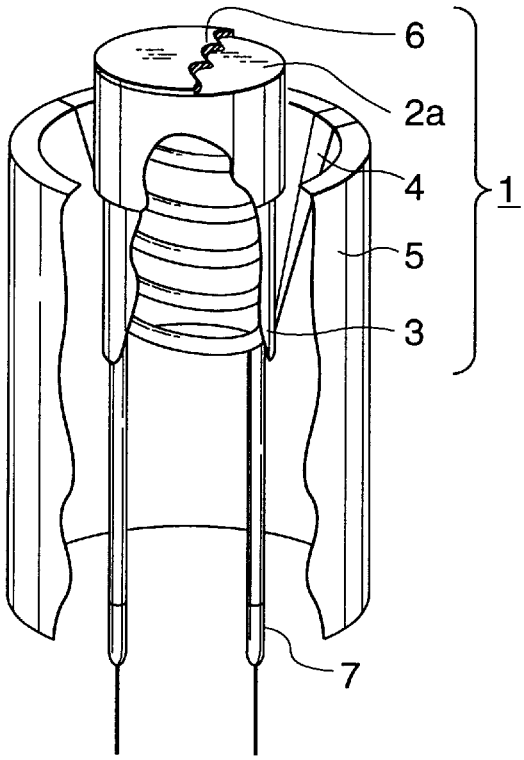

FIG. 1B shows another hanging-type oxide cathode 1. The structure shown in FIG. 1B is different from that shown in FIG. 1A in that a metallic body 2*a* is composed of the disk-shaped metallic body 2 shown in FIG. 1A and a portion which is added to it and protrudes cylindrically along the outside or outer surface of the sleeve 3 at the end of the disk shape.

Figure 2A:
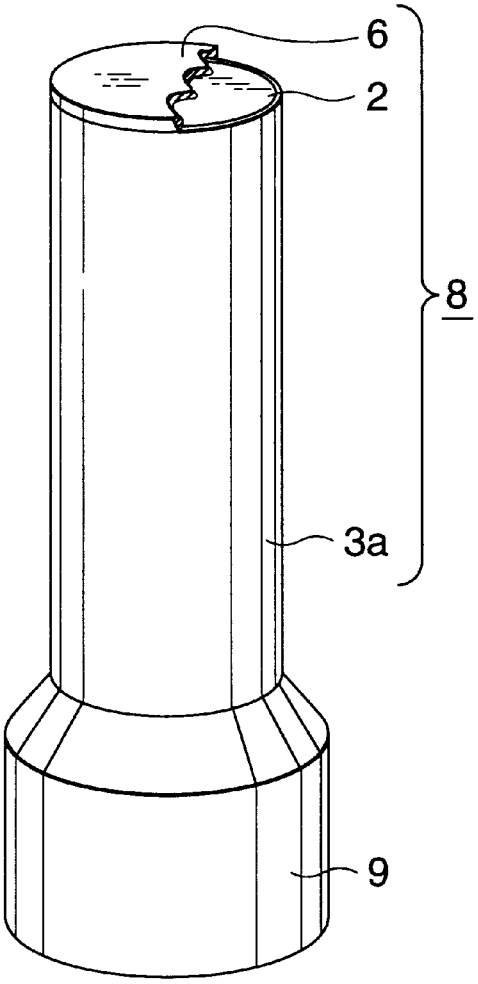
FIGS. 2A and 2B are perspective views of a general hanging-type oxide cathode structure.
Figure 2B:
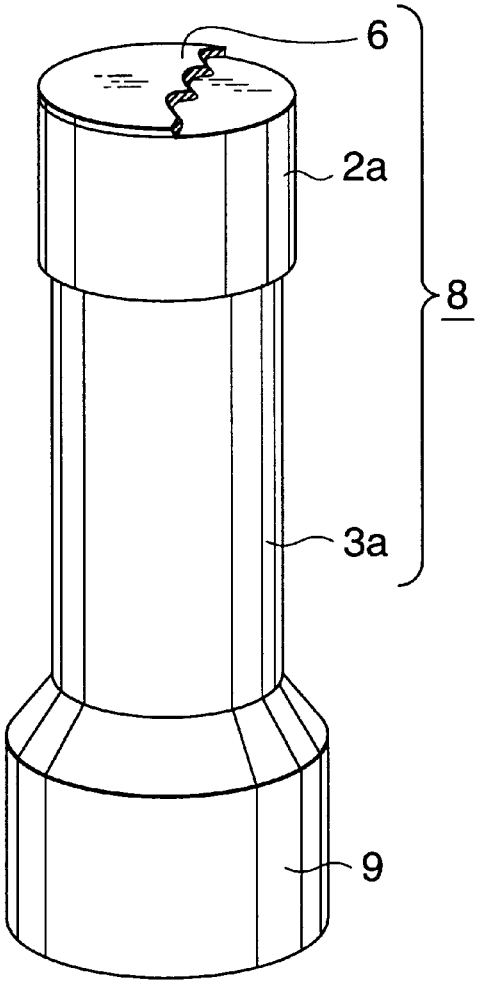

FIGS. 2A and 2B show the structures of a general oxide cathode 8. As seen from FIGS. 2A and 2B, the oxide cathode 8 is composed of a sleeve 3*a* having a cylindrical portion; a disk-shaped metallic body 2 (FIG. 2A) arranged at the one end of the sleeve 3*a,* or a metallic body 2*a* (FIG. 2B) which is arranged so as to cover the one end of the sleeve 3*a,* has a plane covering the end and is formed partially in a cylindrical shape; and a carbonate layer 6 formed on the plane of the metallic body 2 or metallic body 2*a*.

Now, assembling the oxide cathode in the present invention is defined, in the case of the hanging-type oxide cathode 1, as combining the metallic body 2 (although the metallic body 2*a* is included, only the metallic body 2 is used for convenience of explanation), sleeve 3, ribbon 4 and eyelet 5, and in the case without hanging-type structure as combining the metallic body 2 and sleeve 3.

An explanation will be given of a process for fabricating a general oxide cathode. First, the oxide cathode will be assembled in an assembling step. Next, in a first cleaning step, the assembly is cleaned to remove dust or oil applied during the assembling step. In the first drying step, the cleaning solution applied to the assembly in the cleaning step is dried. In a reduction processing step, the assembly is subjected to hydrogen processing at a high temperature of about 1000° C. in a hydrogen atmosphere. In an applying step, fine granular crystals of the carbonate of alkaline-earth metals containing barium, which serves as the carbonate layer 6 shown in FIGS. 1A, 1B and 2A, 2B, is applied on the upper surface of the metallic body 2 (applying step). Finally, in the second drying step, the carbonate layer 6 thus applied is dried.

The process as described above is generally carried out as the process of fabricating a unit of the oxide cathode. The oxide cathode thus completed, after it is built in an electron tube to be actually used, will be used the electron tube such as CRT.

An explanation will be given of the deformation of the oxide cathode which will occur in each of the steps described above.

Placing special emphasis on the thermal efficiency, the sleeve 3 in the oxide cathode is made thin. Therefore, when force is applied on the periphery of the sleeve 3, the sleeve 3 is very likely to deform. The hanging-type oxide cathode 1 is also likely to deform. The oxide cathode will deform in two kinds of manners. In the first manner, the sleeve 3 deforms plastically (deformation "A"). In the second manner, although the center axes of the eyelet 5 and sleeve 3 must be essentially coincident, the ribbon 4 deforms plastically and become eccentric to the eyelet 5 (deformation "B"). These kinds of deformations will occur simultaneously or individually. On the other hand, the eyelet 5, which is thicker than the sleeve 3 and ribbon 4, is difficult to deform. Thus, because of its structure, the hanging-type oxide cathode 1 is necessarily liable to suffer from two kinds of deformations. It should be noted that the ribbon 4, which is fragile in structure, is likely to deform (in the manner of deformation "B").

As described above, care must be paid for dealing with the oxide cathode which is likely to deform. For this reason, various jigs for storage and alignment have been used. An explanation will be give of an example of dealing with the oxide cathode in the steps after assembling.

Immediately after the assembling is completed, several thousands of oxide cathodes are gathered in a vessel and transported to the cleaning step. At this time, since the large number of oxide cathodes are stored or transported in their stacked state, some of the stacked oxide cathodes will deform unfortunately in the manner of deformation "A" or "B" ("B" occurs in only the hanging-type oxide cathode).

In the cleaning step also, the several thousands of oxide cathodes are simultaneously cleaned in the single vessel so that some suffer from the deformation "B". In the steps to the hydrogen processing step, the deformations "B" in various levels occur for the reason described above.

In the hydrogen processing step also, the several thousands of oxide cathodes housed in a vessel of nickel are passed through a hydrogen furnace. After the hydrogen processing, when the temperature of the oxide cathodes are reduced to room temperature, the oxide cathodes must be aligned one by one for preparation of the subsequent carbonate paste applying step for forming the carbonate layer 6. In this case, an automated aligning machine is used. However, because the hydrogen processing is performed at a high temperature, the individual oxide cathodes will be sintered and joined at their contact portion therebetween so that they become difficult to be separated from each other.

In such a case, the oxide cathodes must be separated carefully. However, if the sleeves 3 were joined with each other unfortunately, an attempt for separation leads to both deformations "A" and "B".

After the hydrogen processing, because the crystal grains in the metal grow and the impurities contained therein are reduced and evaporate to decrease, the oxide cathodes are greatly softened to decrease the strength. Thus, the oxide cathodes become deformed more easily.

An explanation will be given of the step of applying the carbonate paste in accordance with the present invention.

Figure 3:
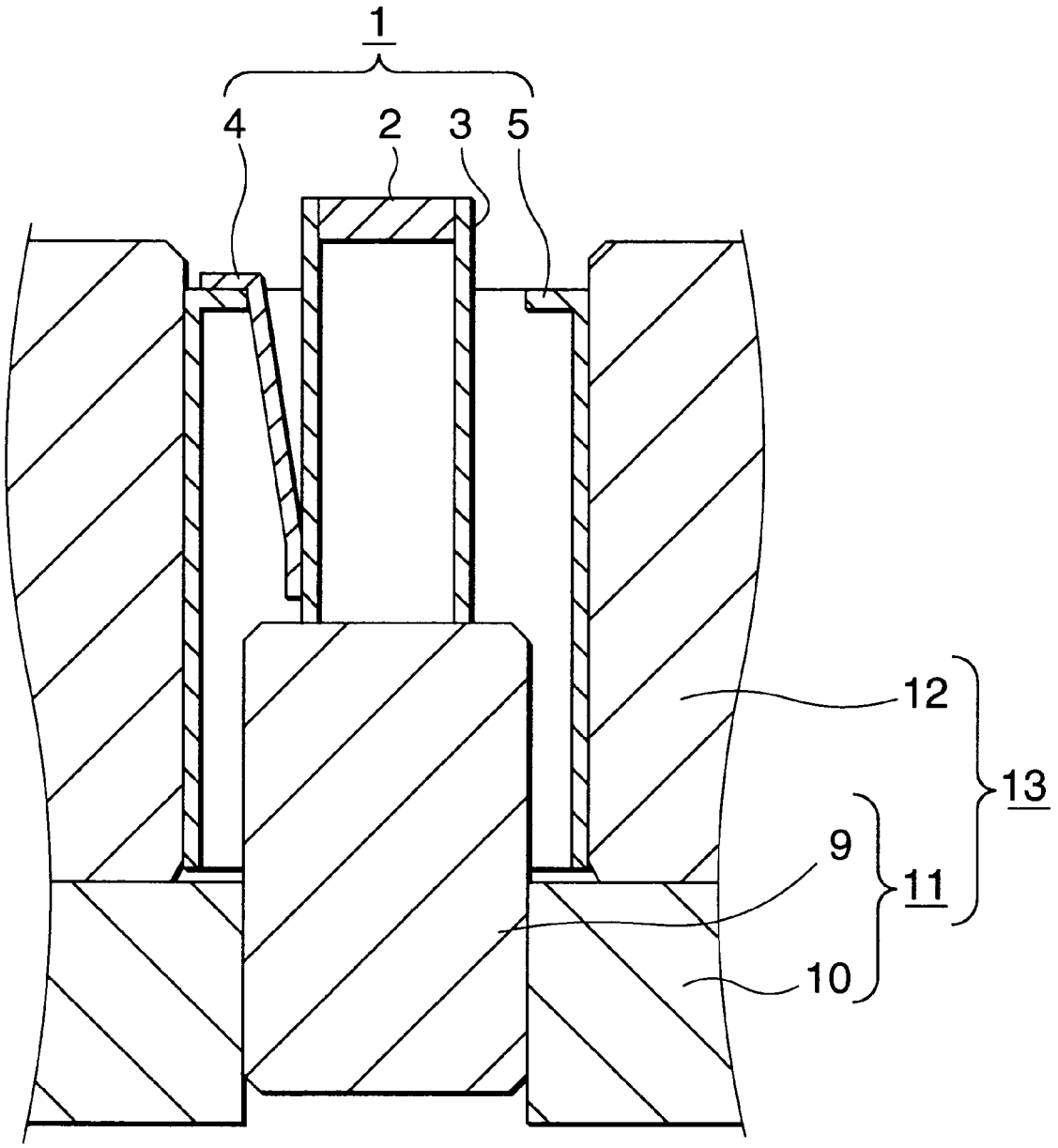
FIG. 3 is a schematic sectional view of the basic structure of an oxide cathode aligning/fixing jig according to the first embodiment of the present invention.

FIG. 3 is a sectional view showing the fixed state of a single hanging-type oxide cathode 1 when the carbonate layer 6 is formed on the upper surface of the metallic body 2 of the oxide cathode 1. In FIG. 3, reference numeral 9 denotes a member for supporting the bottom of the sleeve 3 of the hanging-type oxide cathode 1. Reference numeral 10 denotes a base which constitutes a base member 11 as well as the sleeve bottom supporting member 9. Reference numeral 12 denotes a member for supporting the side of the eyelet 5 of the hanging-type oxide cathode 1. The upper surface of the base 10 and the lower surface of the eyelet side supporting member 12 are kept in contact with each other during the screen printing. The base member 11 (lower securing jig) and eyelet side supporting member 12 (upper securing jig) constitute an oxide cathode aligning/fixing jig 13.

The hanging-type oxide cathode 1 has a structure in which the outer periphery of the cylindrical sleeve 3 having a small diameter is suspended from the inner periphery of the cylindrical eyelet 5 having a large diameter by three ribbons 4, and the sleeve 3 partially enters the eyelet 5. Therefore, when load is applied to the sleeve 3 and metallic body 2, their relative positions to the eyelet 5 (in their vertical, horizontal and twisting directions) are likely to vary. Thus, in order to apply the carbonate paste on the hanging-type oxide cathode 1 by the screen printing, it is not sufficient to secure only the eyelet which is the outermost shell. The sleeve 3 and metallic body 2 must be directly supported and secured at desired positions.

To this end, in the oxide cathode aligning/securing jig 13 shown in FIG. 3, the eyelet side supporting member 12 is provided to support the eyelet 5 from its outer periphery so that the horizontal position of the eyelet is limited. Further, the sleeve bottom supporting member 9 is provided to support the weight of the oxide cathode itself from the bottom of the sleeve 3. Thus, the vertical position of the metallic body 2 welded to the sleeve 3 can be limited or adjusted.

Figure 4:
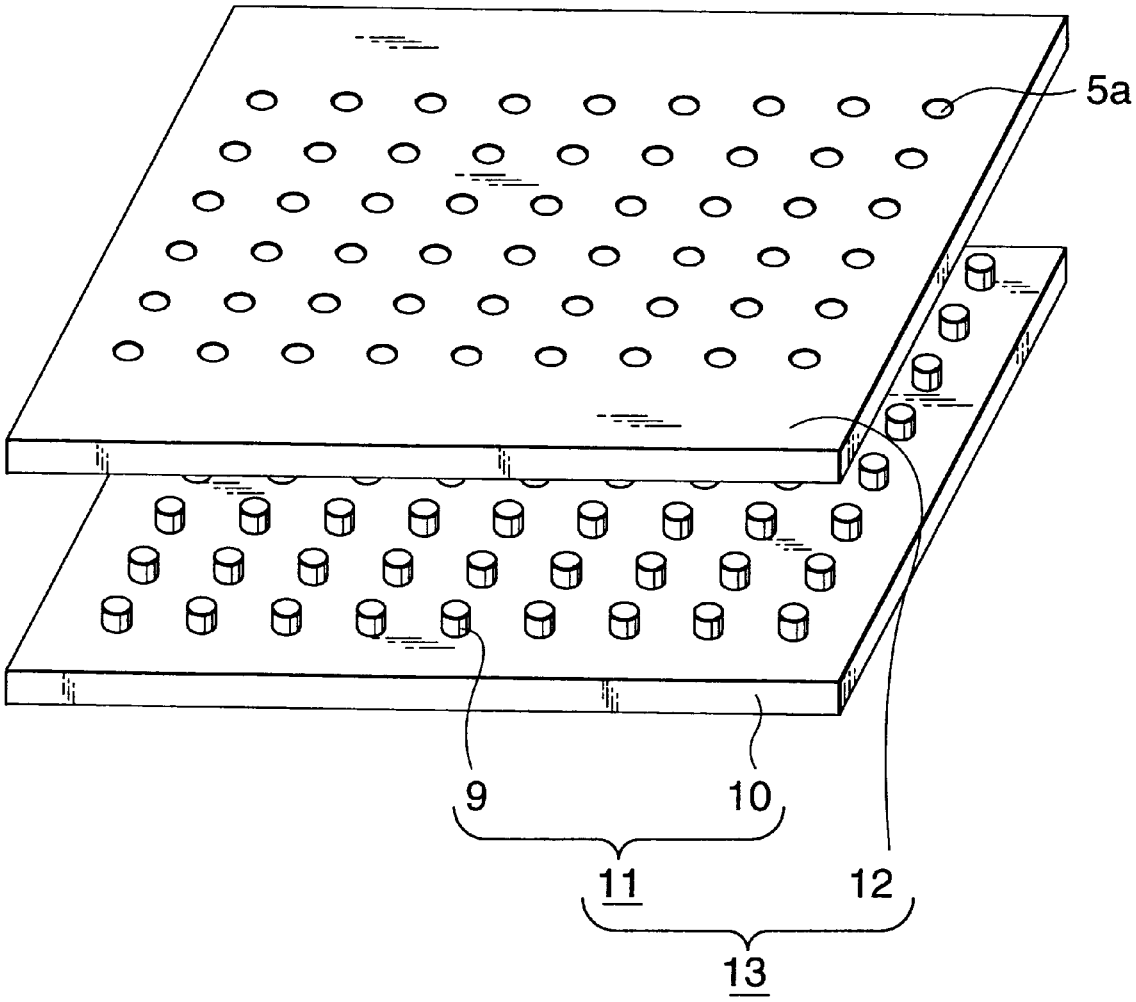
FIG. 4 is a general perspective view of an oxide cathode aligning/fixing jig according to the present invention.

FIG. 3 shows a partial sectional view when a single hanging-type oxide cathode 1 is installed in the oxide cathode aligning/securing jig 13. On the other hand, FIG. 4 shows a general view of the base member 11 and eyelet side supporting member 12. In FIG. 4, reference numeral 5*a* denotes one of cut holes made in the eyelet side supporting member 12. The cut hole has a diameter corresponding to the outer diameter of the eyelet 5. Other like reference numerals refer to like or corresponding parts described previously.

The base 10 and eyelet side supporting member 12 are formed of a plate having a prescribed length, respectively. The sleeve bottom supporting members 9 each being formed of e.g. a cylinder are arranged to protrude from the side of the base 12 which is kept in contact with the eyelet side supporting member 12. The sleeve bottom supporting member 9 has an upper surface whose size is larger than the inner diameter of the cylindrical sleeve 3 of the hanging-type oxide cathode 1 and an area capable of being brought into contact with a partial or entire surface of the bottom of the sleeve 3. As seen from FIG. 4, the cut holes 5*a* and sleeve bottom supporting members 9 are arranged regularly in X and Y directions. Namely, a large number of these members are arranged or aligned on a single jig. For such a reason, by using the jig proposed according to the present invention, hanging-type oxide cathodes 1 can be arranged individually at the positions corresponding to the cut holes 5*a*. Further, by carrying out the screen printing at a time permits the carbonate paste applying processing to be made for a large number of oxide cathodes.

Figure 5:
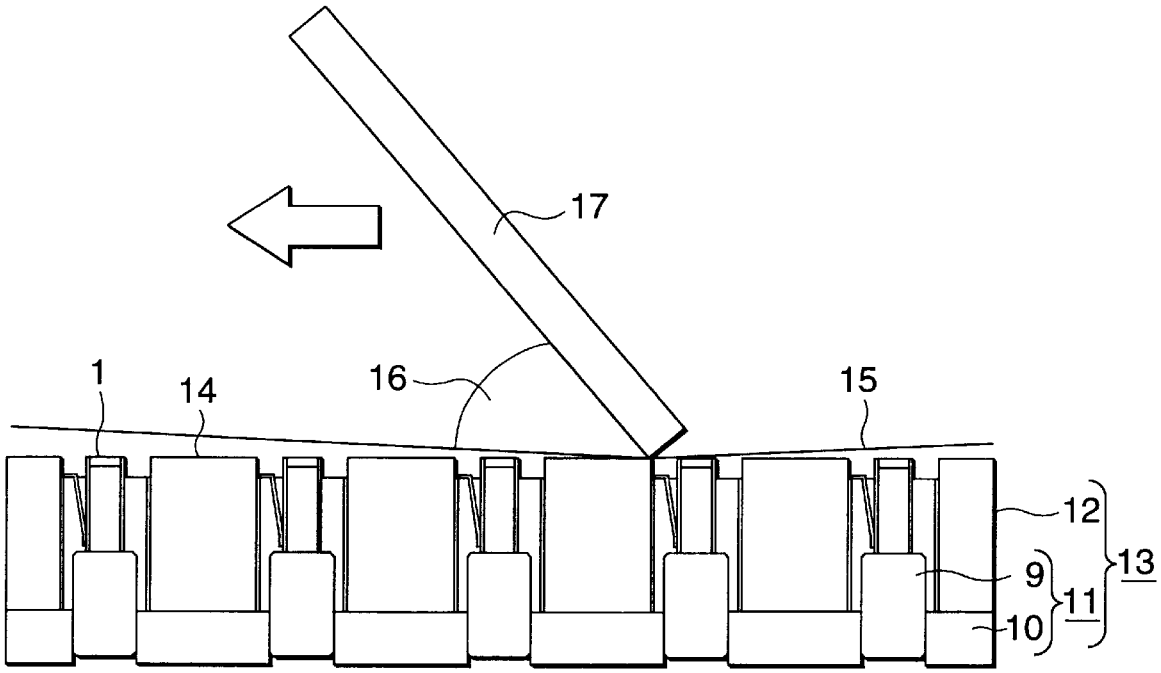
FIG. 5 is a schematic sectional view showing the manner of using the jig according to the present invention to perform screen printing.

Now referring to FIG. 5, an explanation will be given of the screen printing which is a carbonate paste applying step for obtaining the carbonate layer 6. In FIG. 5, reference numeral 14 denotes a screen supporting member which is the surface of the eyelet side supporting member 12 which is not in contact with the base 10 (hereinafter referred to as simply "upper surface").

Reference numeral 15 denotes a screen used for printing. Reference numeral 16 denotes a carbonate paste. Reference numeral 17 denotes a squeeze. The screen supporting member 14, when the hanging-type cathodes 1 are set, is made flush with the upper surface of the metallic body 2 on which the carbonate layer 6 is arranged.

In accordance with the present invention, the carbonate paste will be applied using the squeeze 17 of polyurethane and a mesh-like screen 15 (stainless mesh, silk mesh, etc.) fixed or extended within a frame having a printed pattern formed by masking of emulsion. Specifically, the carbonate paste can be applied on the upper surface of the metallic body 2 of the hanging-type oxide cathode 1 in such a manner that the ink having suitable viscosity for screen printing is introduced on the screen 15 and the squeeze is operated. It will be described in further detail.

Where the carbonate paste 16 is actually applied on the hanging-type oxide cathode 1 by screen printing, in view of the production efficiency, a plurality of hanging-type oxide cathodes 1 are aligned and the squeezing operation is carried out once or several times so that the carbonate paste 16 can be applied simultaneously on each of the metallic bodies 2.

In such a screen printing, it is desired that the metallic bodies 2 which are objects for printing are made flush with one another at their upper surfaces so that they are separated equidistantly from the screen 2, and the positions of the metallic bodies 2 are precisely aligned with the printing pattern of the screen 15. Now it is assumed that a plurality of hanging-type oxide cathodes are set on the oxide cathode aligning/securing jig 13. In this case, if the heights of the upper surfaces of the metallic bodies vary so that they are not separated equidistantly from the screen 15, the hanging-type oxide cathodes 1 will be brought into contact with the screen 15 in order from the one nearer to the screen 15, thereby supporting the screen 15. Therefore, the metallic bodies 2 which are farther from the screen 15 on average (ones with their upper surfaces are lower) are not brought into contact with the screen 15 so that the carbonate paste 16 is not applied to the bodies.

It has been known that the delicate alignment between the screen 15 and metallic body 2 influences the thickness of the printed carbonate paste 16, i.e. of the carbonate layer 6.

Therefore, it is desired that the upper surfaces of the metallic bodies 2 are made flush with each other so that the metallic bodies 2 are separated equidistantly from the screen 15 as possible.

The thickness of the printed carbonate paste 16 is directly related with the thickness of carbonate layer 6 so that it determines the life characteristic of an electron tube. It is a particularly important item to be managed in the mass production of the oxide cathodes. Therefore, it is desired that the oxide cathodes mass-produced have an equally required thickness.

If misalignment occurs between the metallic bodies 2 and the printed pattern, the carbonate 16 is not uniformly on the whole surface of the metallic bodies 2. The carbonate paste 16 may be applied on the side of the sleeve 3.

An explanation will be given of a method of fabricating an oxide cathode aligning/securing jig 13.

First, the eyelet side supporting member plate 12 is prepared which is a metallic plate, e.g. aluminum alloy plate with no planar distortion on average having a thickness providing a height slightly lower than that of the hanging-type oxide cathode 1 (actually the thickness providing a height lower than that of the cathode by about 1 mm).

Next, the metallic plate is cut out into an area (actually the area of 300×300 $mm^2$) on which a plurality of oxide cathodes can be arranged. Further, cut holes 5*a* each for accommodating the eyelet 5 are made at high precision so that they are arranged at regular prescribed intervals (actually, the holes each having a diameter slightly larger than the outer diameter of the eyelet are drilled at regular prescribed intervals at a pitch of 4 mm±10 $\mu$m so that a gap of about 30 $\mu$m is placed on one side with respect to the outer diameter $\phi$ of 3.6 mm of the eyelet 5).

In order to hold/secure the plurality of sleeve bottom supporting members 9 at their uniform heights, like the eyelet side supporting member 12, the base 10 is prepared which is a metallic plate with no planar distortion on average having a thickness enough to hold the eyelet side supporting member 12 which is an upper jig member. Further, openings each for receiving the sleeve bottom supporting member 9 are cut in the metallic plate 10. Incidentally, the sleeve bottom supporting members 9 themselves are separately prepared by cutting, and pressed in the openings, respectively. Thus, the base member 12 composed of the sleeve bottom supporting members 9 and the base 10 is prepared.

Thereafter, in order to align the heights of the tips of the sleeve bottom supporting members 9 which are brought into contact with the bottoms of the sleeves 3 when the oxide cathodes are set, the tip surfaces of the sleeve bottom supporting members 9 thus pressed in are simultaneously ground using a grinding machine. By this grinding, the heights of the sleeve bottom supporting members can be aligned very precisely.

Incidentally, in the oxide cathode aligning/fixing jig 13 fabricated according to this embodiment, the heights from the base 10 to the sleeve bottom supporting members 9 fell within a variation of 5 $\mu$m.

In order that the eyelet side supporting member 12 which is the upper jig member and the base 10 can be easily coupled with each other in a state where the plurality of oxide cathodes have been inserted in them, the upper jig member is provided with two positioning pins (not shown) and the lower jig is provided with the corresponding positioning holes (not shown). By using the oxide cathode aligning/fixing jig 13 thus manufactured, the heights of the upper surfaces of the plurality of metallic bodies 2 can be made equal at high precision.

An explanation will be given of a method of applying electric radiation substance on the upper surface of a certain metallic body 2 which is a component of the oxide cathode using the oxide cathode aligning/fixing jig described above.

A printing machine includes a table for attaching at least the oxide cathode aligning/fixing jig, a screen 15, a mechanism of securing the screen 15, and a squeeze 17 capable of aligning the table with the screen 15 and of adjusting the distance between the screen 15 and an printing object. The printing machine is designed so that it can squeeze ink (corresponding to the carbonate paste) from the screen 15 by a squeezing operation on the screen 15 and apply the ink on the upper surface of the metallic body 2 which is a printing object.

The screen 15 may be mesh stainless having 100–400 meshes in which areas requiring no printing are masked by emulsion (diazo resin), and is provided with printing patterns each of which is coincident with each of the metallic bodies arranged uniformly and has a smaller diameter than the metallic body 2 with an aligning allowance.

The carbonate paste 16 serving as the ink in the present invention is prepared by mixing carbonate powder of alkaline-earth metal containing at least barium, which is a main component, with a suitable amount of several kinds of liquid additives (in this embodiment, terpineol, lacquer and high-polymer oil dispersion agent). The other additive than the carbonate may be used as long as it has no problem in the cathode operation and can provide the paste which is suitably used for printing.

First, the hanging-type oxide cathodes 1 are installed with the sleeve bottom supporting members 9 of the base member 11, which correspond to the lower jig, covered with the sleeves 3, respectively. The upper jig is coupled with the lower jig from above using the positioning pins and fixed using its own weight. In this case, the upper jig may be mechanically fixed in such a manner that it is bolted on the base member 11 which corresponds to the lower jig.

At this time, the heights of the upper surfaces of the metallic bodies 2 of the respective hanging-type oxide cathodes 1 are made equal. Their horizontal positions are also secured regularly at high precision by securing the outer surfaces of the eyelets 5 by the upper jig. In this state, with the oxide cathode aligning/fixing jigs attached to the printing machine, the printing patterns are visually aligned with the upper surfaces of the metallic bodies 2 and the test printing for alignment. In this case, a positioning mechanism is previously provided on a fixed stand of the printing machine. For example, the lower jig is provided with precise positioning holes, and the table of the printing machine is provided with two positioning pins.

Next, the printing state is confirmed. If the printing patterns are displaced from the metallic bodies 2, these displacement amounts are corrected using the aligning mechanism attached to the printing machine (If there is no displacement, the jig being used is removed from the printing machine, and the hanging-type cathode oxides are transferred). Upon completion of the correction, the paste printed on the surfaces of the metallic bodies is wiped out to clean the surfaces of the metallic bodies 2, and the test printing is carried out again. The test printing is carried out several times to eliminate the displacement of the metallic bodies from the printing patterns. Thereafter, the hanging-type oxide cathodes 1 are transferred to a main printing.

The above test printing is a necessary operation when the screen 15 is exchanged or the printing is carried out at the first time. However, from the printing at the second time under the same condition, the test printing is not required because the metallic bodies can be positioned precisely using the positioning pins of the positioning mechanism.

Upon completion of the main printing, the hanging-type oxide cathodes 1 printed with carbonate paste 16 in state installed in the oxide cathode/fixing jig 13 is left in air, otherwise transferred into a drying furnace adjusted to the temperature of 100° C. The liquid composition such as terpineol is vaporized and the carbonate paste 16 is dried and fixed to obtain a carbonate layer 6. Thereafter, the hanging-type oxide cathodes 1 are carefully taken out from the jig, and arranged again in another storage vessel. These hanging-type oxide cathodes 1 can be applied to electron tubes in the same method and process as the oxide cathodes manufactured by the conventional spray applying technique as disclosed in JP 64-5417.

Incidentally, the electron tubes refer to the vacuum tubes (diode tube, triode tube, etc.) for controlling thermal electrons, represented by e.g. CRT.

In this way, by using the oxide cathode aligning/fixing jig 13 having a basic structure as shown in FIG. 3, the carbonate paste 16 constituting the carbonate layers can be simultaneously printed on a large number of oxide cathodes so that the printing patterns on the screen 15 can be easily aligned with the metallic bodies 2.

Further, by the screen printing, the carbonate paste 16 having a uniform thickness can be applied to the hanging-type oxide cathodes 1. Actually, as a result of having measured the thickness of the carbonate layer 6 after printing/drying, it is confirmed that the carbonate paste could be applied at the precision of 70±30 $\mu$m with respect to a target value of 70 $\mu$M. As for the hanging-type oxide cathode with great deformation (deformation "B"), the printing was not successfully carried out so that the carbonate paste 16 disadvantageously fell on the side of the sleeves 3.

In accordance with the first embodiment of the present invention, since the oxide cathode aligning/fixing jig 13 having a basic structure as shown in FIG. 3 is used, the oxide cathodes can be supported/secured in their horizontal positions by the eyelet side supporting member 12 which support the eyelets 5 from their periphery. Specifically, each sleeve 3 is supported by the ribbon 4 of the hanging-type oxide cathode 1, and the metallic body 2 can be finally secured in its horizontal position. Further, the own weight of the hanging-type oxide cathode 1 is supported by the sleeve bottom supporting member 9 so that the metallic body 2 welded to the sleeve 3 is secured in its vertical position.

The structures as shown in FIG. 3 are arranged regularly in X-Y directions as shown in FIG. 4, and the oxide cathodes are tightly introduced into the fixing jig so that the plurality of the oxide cathodes are arranged at high precision. Thus, the screen printing can be performed for the plurality of oxide cathodes at a time.

Hitherto, an explanation was given for the disk-shaped metallic body of the hanging-type cathode. However, as shown in FIG. 1B the metallic body 2*a* partially formed in a disk-shape can also be processed using the same oxide cathode aligning/fixing jig, thereby providing the same effect.

Embodiment 2

Now, referring to FIG. 2, an explanation will be given of the second embodiment of the present invention.

In the first embodiment, the eyelet side supporting member 12 constituting the oxide cathode aligning/fixing jig 13 supports and secure the horizontal position of the hanging-type oxide cathode 1 by supporting the outside or outer surface of the eyelet 5 from the periphery. On the other hand, in this embodiment, as seen from a sectional view, the eyelet side supporting member 12*a* has a sleeve side supporting member 18 at its upper end.

In order to support and secure the upper outside or outer surface of the cylindrical sleeve 3, the sleeve side supporting member 18 intends to correct forcibly the coaxial displacement (deformation "B") between the eyelet 5 and sleeve 3 and make their alignment with the screen 15 at high precision.

Figure 6:
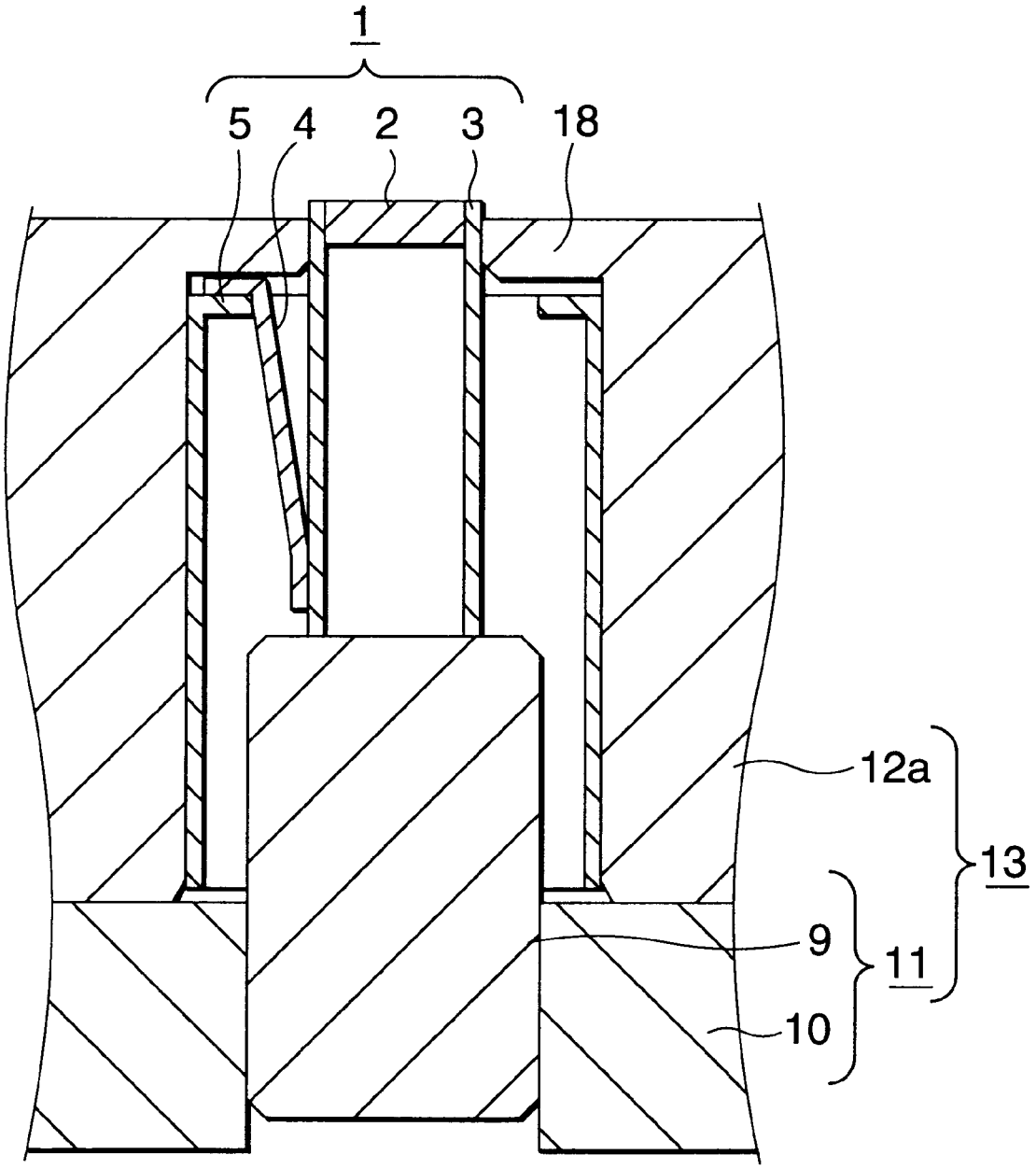
FIG. 6 is a schematic sectional view of the basic structure of an oxide cathode aligning/fixing jig according to the second embodiment of the present invention.

The basic structures as shown in FIG. 6 are arranged regularly in X-Y directions as shown in FIG. 4, and the oxide cathodes are tightly introduced into the fixing jig so that the plurality of the oxide cathodes are arranged at high precision. Thus, the screen printing can be performed for the plurality of oxide cathodes at a time.

Embodiment 3

Figure 7:
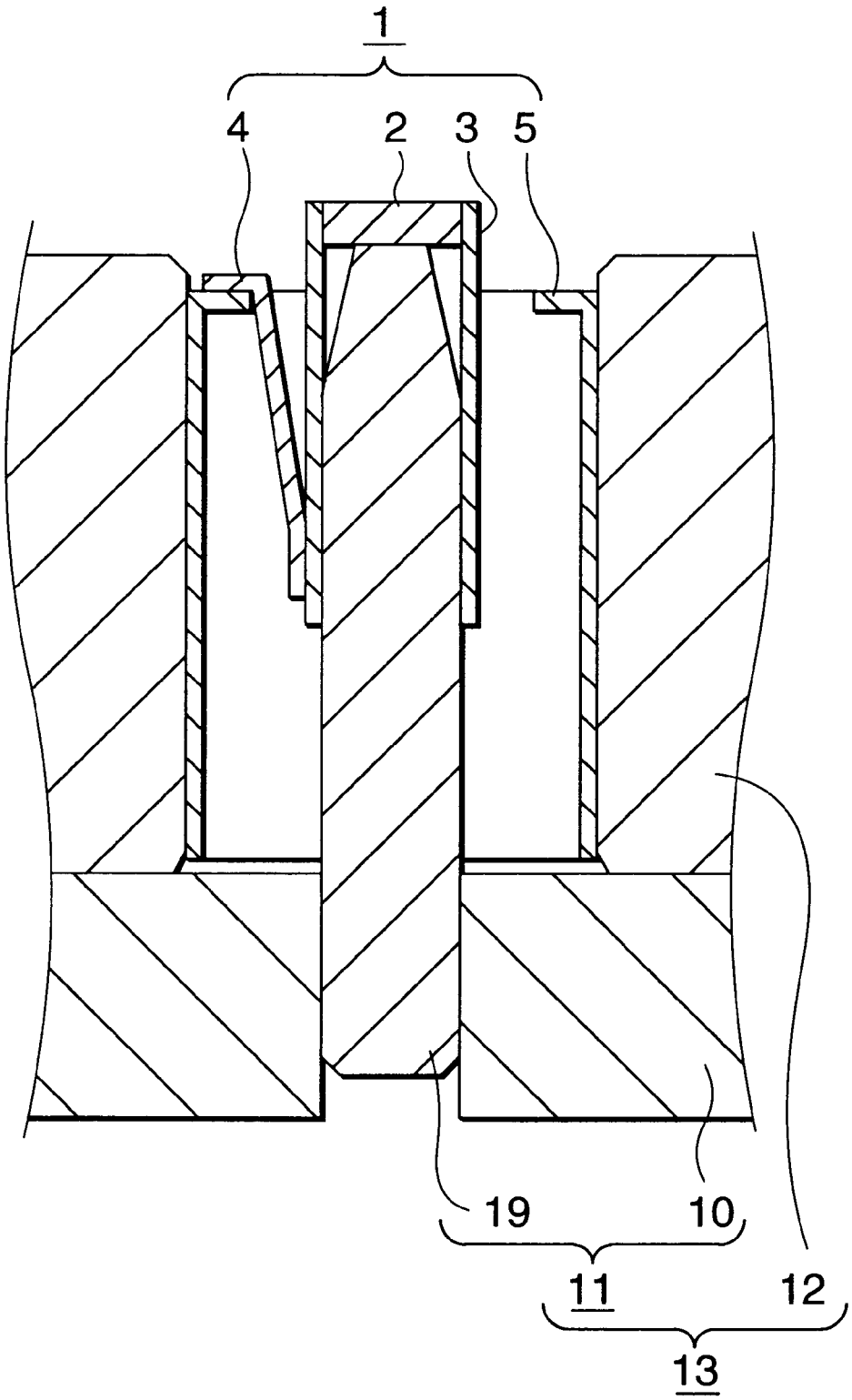
FIG. 7 is a schematic sectional view of the basic structure of an oxide cathode aligning/fixing jig according to the third embodiment of the present invention.

Referring to FIG. 7, an explanation will be given of the third embodiment of the present invention.

In the first and the second embodiment, the base member 11 constituting the oxide cathode aligning/fixing jig 13 includes the sleeve bottom supporting member 9 to support the sleeve 3 from its bottom. On the other hand, in this embodiment, as seen from a sectional view of FIG. 7, the base member 11 has a member 19 for supporting the bottom of the metallic body and sleeve internal surface. The member 19 is a cylinder having a diameter corresponding to the internal diameter of the cylindrical sleeve 3 which serves to support the bottom of the metallic body 2 at its upper face and to support the inside or internal surface of the sleeve 3.

When the oxide cathode 1 is installed in the oxide cathode aligning/fixing jig 13, the member 19 supports and secures the horizontal position of the sleeve 3 and supports the own weight of the hanging-type oxide cathode 1. Thus, it limits the vertical position of the metallic body 2 and directly supports the internal surface of the sleeve 3, thereby correcting forcibly the coaxial displacement (deformation type B) between the eyelet 5 and sleeve 3 and making their alignment with the screen 15 at high precision.

Incidentally, in order that the hanging-type oxide cathode 1 can be easily installed in the jig 13 even when the deformation "B" occurs, the upper end of the member 19 in contact with the metallic body 2 is tapered and hence has a smaller diameter than the internal diameter of the sleeve 3. When the hanging-type oxide cathode 1 is introduced so that the internal surface of the sleeve 3 is in contact with the outer surface of the member 19, the deformation type B can be corrected smoothly.

The basic structures as shown in FIG. 7 are arranged regularly in X-Y directions as shown in FIG. 4, and the oxide cathodes are tightly introduced into the fixing jig so that the plurality of the oxide cathodes are arranged at high precision. Thus, the screen printing can be performed for the plurality of oxide cathodes at a time.

Embodiment 4

Figure 8:
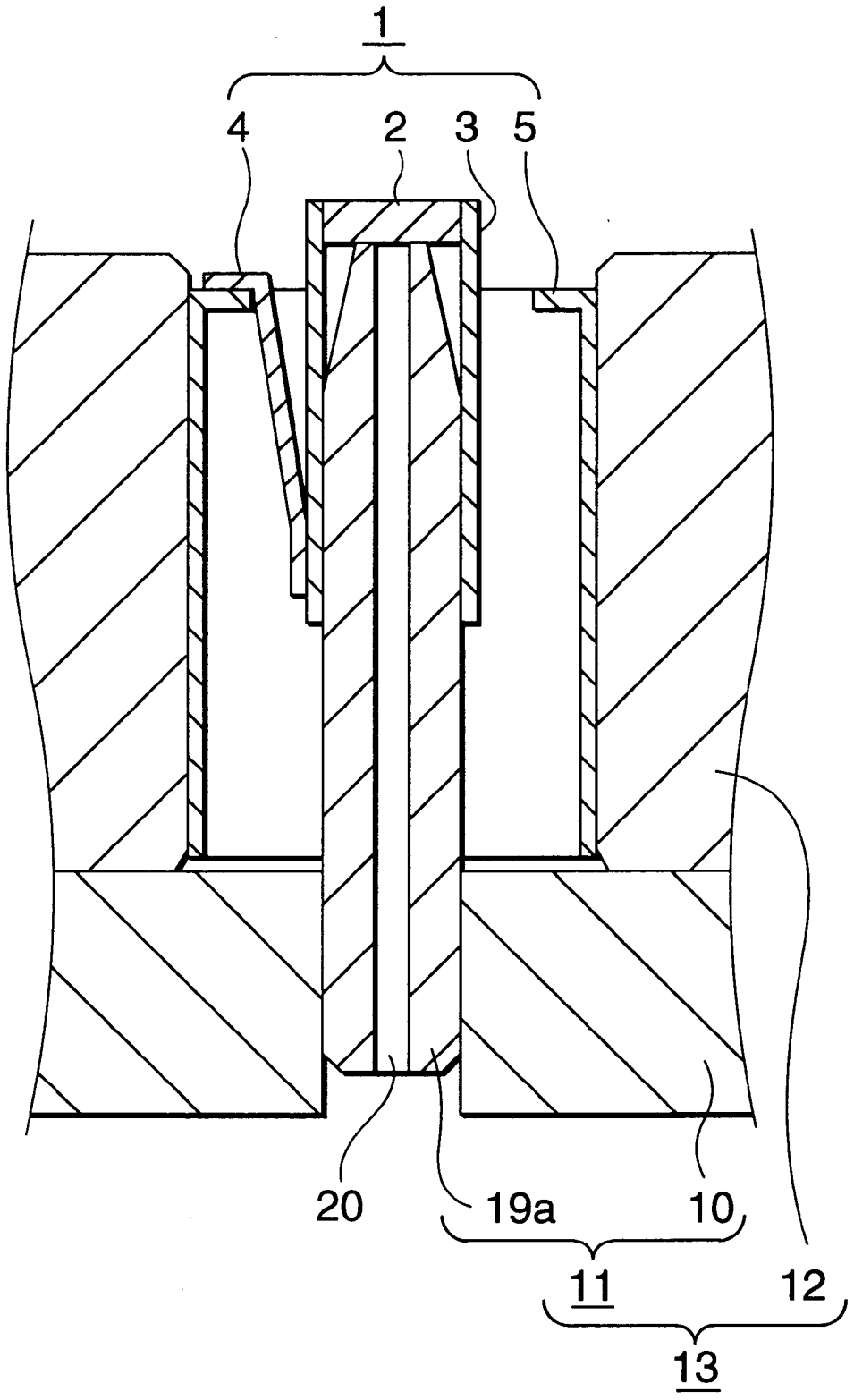
FIG. 8 is a schematic sectional view of the basic structure of an oxide cathode aligning/fixing jig according to the fourth embodiment of the present invention.

Referring to FIG. 8, an explanation will be given of the fourth embodiment. In the third embodiment described above, the oxide cathode aligning/fixing jig 13 is provided with the member 19 for supporting the bottom of the metallic body and sleeve internal surface which supports the sleeve 3 from its inside and the bottom of the metallic body welded to the sleeve 3. On the other hand, in the fourth embodiment 4, the member 19*a* for supporting the bottom of the metallic body 2 and the internal surface of the sleeve 3 has absorbing function so that it can support the bottom of the metallic body and adsorbs it.

As seen from FIG. 8, the member 19*a* for supporting the bottom of the metallic body and the internal surface of the sleeve has a sweeping hole 20. Therefore, by sweeping air through the sweeping hole 20 using a rotary pump, the bottom of the metallic body 2 can be attracted to the member 19*a*.

The basic structures one of which is shown in FIG. 8 are arranged regularly in X-Y directions as shown in FIG. 4, and the oxide cathodes are tightly introduced into the fixing jig so that the plurality of the oxide cathodes are arranged at high precision and the upper surfaces of the metallic bodies 2 are made flush surely by the sweeping. Thus, the screen printing can be performed for the plurality of oxide cathodes 1 at a time.

Embodiment 5

Referring to FIG. 9, an explanation will be given of the fifth embodiment of the present invention.

Figure 9A:
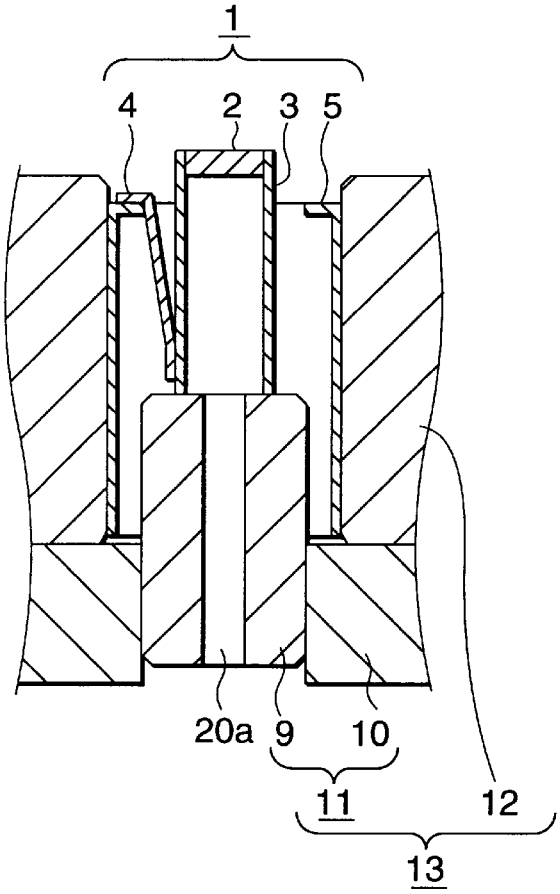
FIGS. 9A and 9B are schematic sectional views of the basic structure of an oxide cathode aligning/fixing jig according to the fifth embodiment of the present invention.
Figure 9B:
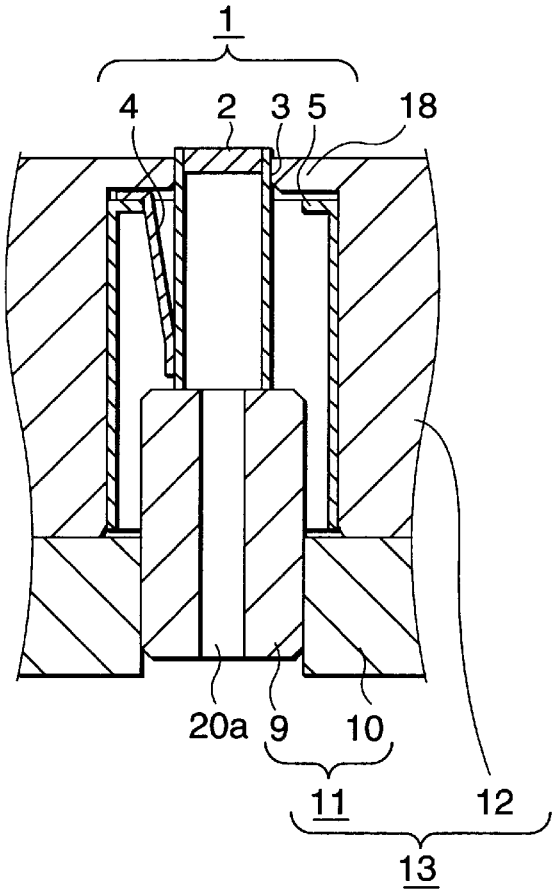

In this embodiment, as seen from FIGS. 9A and 9B, the sleeve bottom supporting member 9 of the oxide cathode aligning/fixing jig 13 according to each of the first and second embodiment has a sweeping hole 20*a*.

By using the oxide cathode aligning/fixing jig 13 provided with the sweeping hole 20*a* as shown in FIG. 9, in addition to the effects described in connection with the first and the second embodiment, the plurality of hanging-type oxide cathodes 1 can be held and secured more surely at a time, thereby permitting improved screen printing.

Embodiment 6

Figure 10:
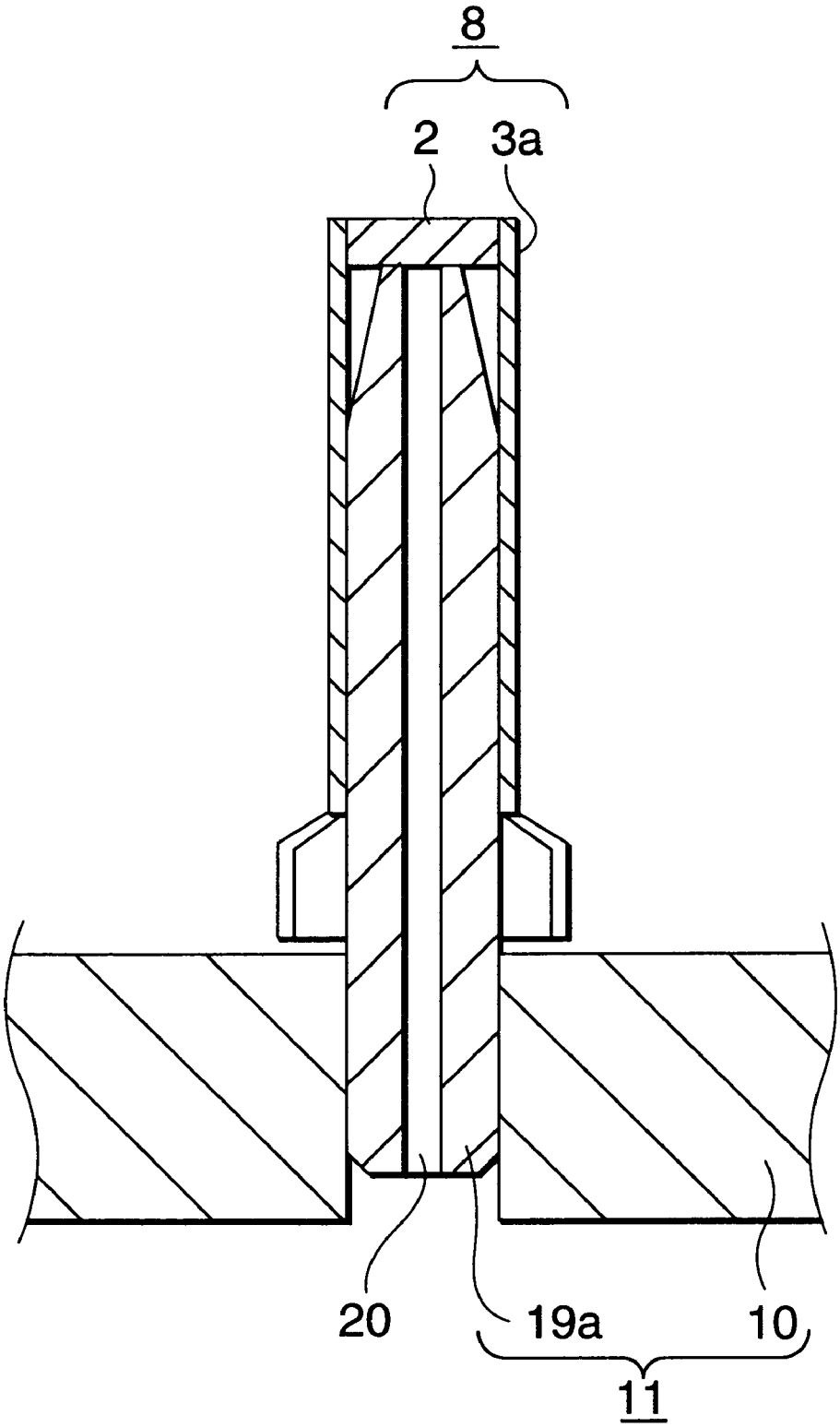
FIG. 10 is a schematic sectional view of the basic structure of an oxide cathode aligning/fixing jig according to the sixth embodiment of the present invention.

Referring to FIG. 10, an explanation will be given of the eighth embodiment of the present invention.

In the first to fifth embodiments, an explanation was given of the oxide cathode aligning/fixing jig 13 which is mainly used when the carbonate layer 6 is formed for the hanging-type oxide cathodes 1. This eighth embodiment relates to the case where the carbonate layer 6 is formed for the oxide cathode 8 having no hanging structure whose general structure is shown in FIG. 2.

Unlike the hanging-type oxide cathode 1, the oxide cathode 8 having no hanging structure does not produce the deformation that the eyelet 5 and the sleeve 3 are not coaxial with each other. Therefore, it is not necessary to use the eyelet side supporting member 12 which is an upper securing jig of the fixing jig as shown in FIG. 4. Instead of this, with the cathodes 1 being secured using the member corresponding to the base member 1, the carbonate paste 16 can be screen-printed on the upper faces of the metallic bodies 2.

As shown in FIG. 10, the cylindrical member 19*a* having a sweeping hole 20, for supporting the bottom of the metallic body and the internal surface of the sleeve has a sweeping hole 20 supports the own weight of the oxide cathode 8 from the bottom of the metallic body. Thus, it limits the vertical position of the metallic body 2 and directly supports the internal face of the sleeve 3. Further, by sweeping air through the sweeping hole 20 using a rotary pump, the bottom of the metallic body 2 can be positively attracted to the member 19*a,* thereby securing the metallic body more precisely.

The basic structures, one of which is shown in FIG. 10, are arranged regularly in X-Y directions in the lower member as shown in FIG. 4, and the oxide cathodes 8 are set in the members 19*a* each for supporting the bottom of the metallic body and the internal surface of the sleeve, aligned on the lower member so that the plurality of the oxide cathodes are arranged at high precision and the upper surfaces of the metallic bodies 2 are made flush surely by the sweeping effect. Thus, the carbonate paste having a uniform thickness can be applied to the plurality of oxide cathodes 1 at a time.

In the above explanation of this embodiment, the member corresponding to the eyelet side supporting member 12 which is an upper securing jig of the oxide cathode aligning/fixing jig as shown in FIG. 4 is not used. However, in view of necessity of the screen supporting member during the screen printing, the similar upper member may be used in screen printing. In this case, it is needless to say that the upper member, which has a function of supporting the outside of the sleeves 3 each constituting the oxide cathode 8, permits the oxide cathodes to be secured precisely and the carbonate paste to be applied uniformly.

Embodiment 7

Referring to FIG. 11, an explanation will be given of the seventh embodiment of the present invention.

In the first to fifth embodiments described above, the heights of the upper surfaces of the eyelet side supporting member 12, i.e. screen supporting member 14 and of the metallic body were not specified. Namely, these heights are not necessarily coincident to each other, but the surface of the metallic body 2 is illustrated to be slightly higher than that of the screen supporting portion 14. In this embodiment, as seen from FIGS. 11A–11C, the height of the upper surface of the upper fixing jig constituting the oxide cathode aligning/fixing jig 13, i.e. screen supporting member 14 is made equal to that of the upper surface of the hanging-type oxide cathode 1 or oxide cathode 8.

In the screen printing, as shown in FIG. 5, the squeeze 17 being pressed downward is operated on the upper surface of the screen 15 so that the lower surface of the screen 15 is necessarily brought into contact with and pressed to the upper surface of the metallic body 2 which is a printing object. In this case, if the pressing force of the squeeze 17 is strong, great force might be applied to the metallic body 2, thus deforming the oxide cathode.

Figure 11A:
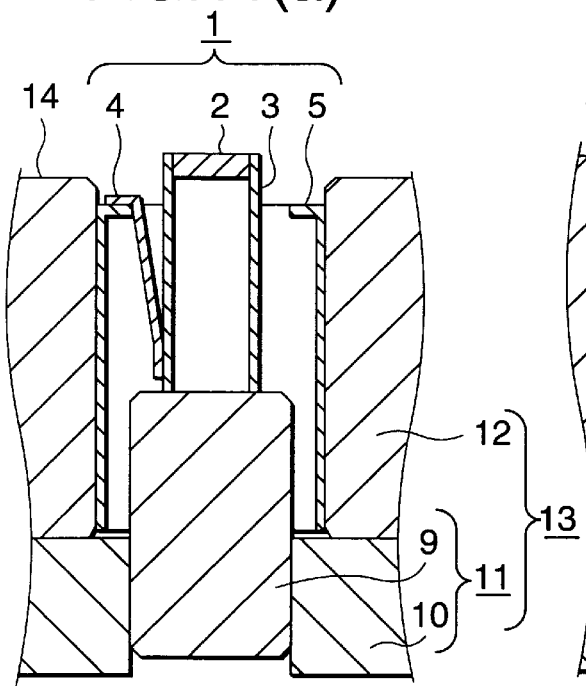
FIGS. 11A–11C are schematic sectional views of the basic structure of an oxide cathode aligning/fixing jig according to the seventh embodiment of the present invention.
Figure 11B:
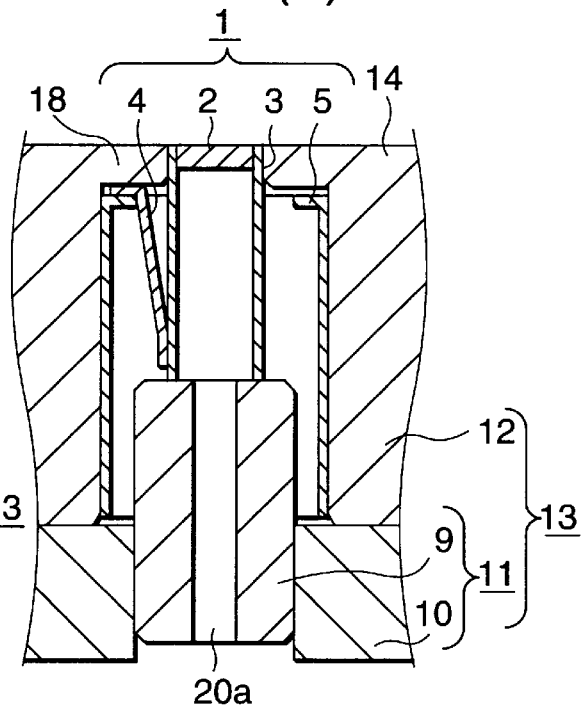

On the other hand, in the structures as shown in FIGS. 11A and 11B, the upper surface of the screen supporting portion 14 is adjusted to be flush with that of the metallic body 2. Thus, the force applied to the metallic body is dispersed so that the deformation of the hanging-type oxide cathode 1 can be surely prevented. FIG. 11A shows a modification of FIG. 3 which was used for explaining the first embodiment. FIG. 11B shows a modification of FIG. 6 which was used for explaining the second embodiment.

Figure 11C:
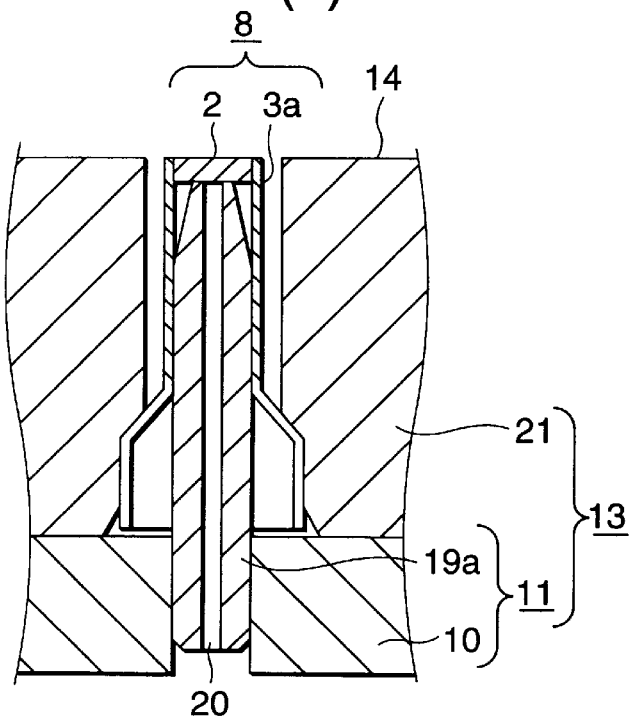

As shown in FIG. 11C, in the screen printing for the oxide cathode 8 with no hanging structure, in which the oxide cathode aligning/fixing jig 13 is provided with the sleeve side supporting member 21 as well as the base member 11 explained in connection with the sixth embodiment, the screen supporting member 14 corresponding to the upper surface of the sleeve side supporting member 21 is adjusted to be flush with the metallic body 2. This provides the same effect.

Embodiment 8

Figure 12A:
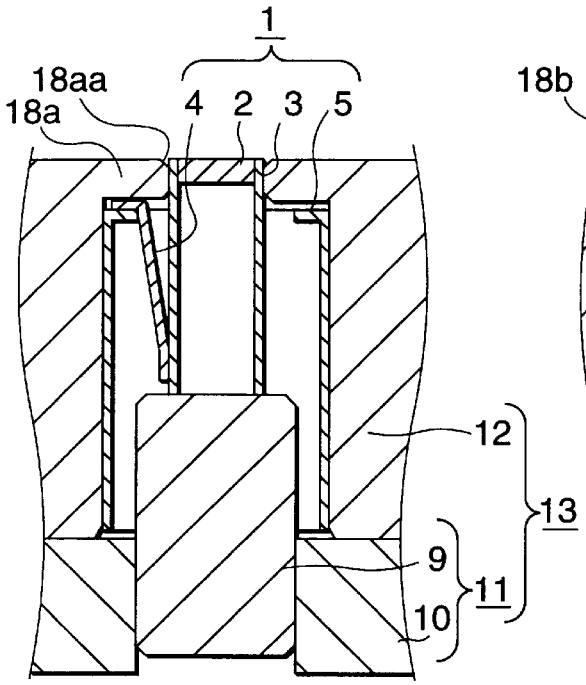
FIGS. 12A–12C are schematic sectional views of the basic structure of an oxide cathode aligning/fixing jig according to the eighth embodiment of the present invention.
Figure 12B:
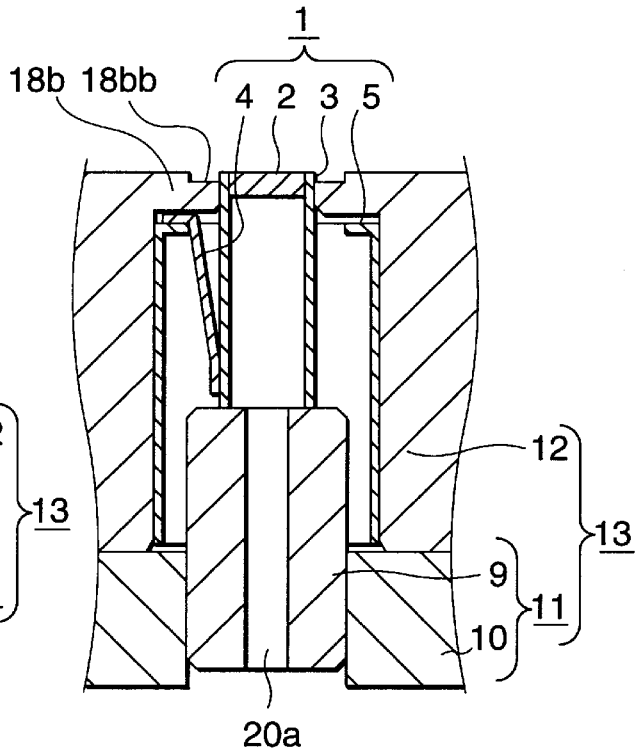
Figure 12C:
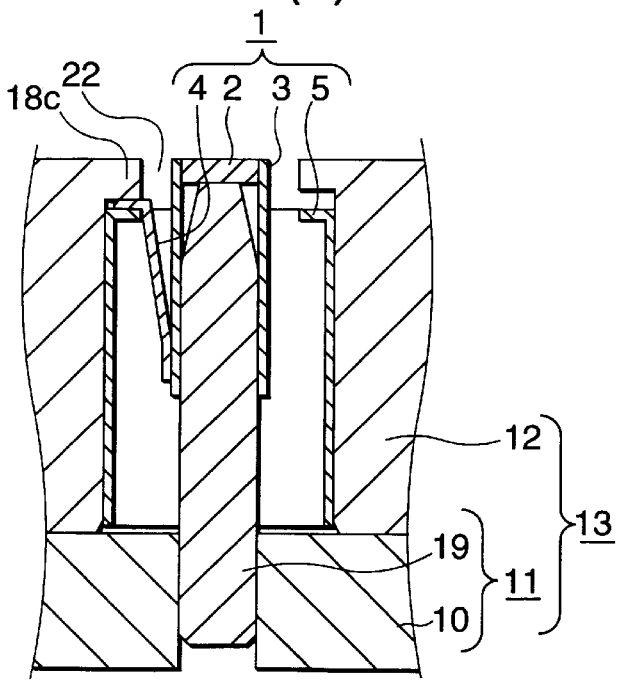

Referring to FIGS. 12A–12C, an explanation will be given of the eighth embodiment.

In this embodiment, as in the seventh embodiment, the screen supporting member 14 which is flush with the upper surface of the metallic body 2 is formed. Further, when the sleeve side supporting member 18 is also installed in the second embodiment as shown in FIG. 6, the upper ends of the sleeve 3 and of the screen supporting member 14 are designed to be brought into contact with each other.

In this case, immediately after the screen printing has been accomplished, because of a capillary action, the carbonate paste may sink into a groove formed between the outer surface of the sleeve 3 and sleeve side supporting member 18. As a result, it may be disadvantageously applied to the outer surface of the sleeve 3.

In the eighth embodiment, as seen from FIGS. 12A and 12B, a taper 18*aa* (FIG. 18A) or a depression (FIG. 18B) is newly formed in the sleeve side supporting members 18*a*, 18*b* corresponding to the end of the screen supporting member 14 so that the capillary action can be prevented, thereby preventing the carbonate paste from being applied to the outer surface of the sleeve 3.

As seen from FIG. 12C, in order to prevent the capillary action, a spot-facing 22 may be provided so that a gap having a prescribed width is formed between the sleeve side supporting portion 18*c* and outer upper end of the sleeve 3 when the hanging-type oxide cathode 1 is arranged in the oxide cathode aligning/fixing jig 13.

Embodiment 9

In the oxide cathode aligning/fixing jig according to the first embodiment as shown in FIG. 3, the horizontal position of the metallic body 2 is supported by the ribbon 4. In the hanging-type oxide cathode 1 having suffered from the deformation "B", the carbonate paste 16 is printed in misalignment with the printing pattern of the screen 15. As a result, the carbonate paste 16 will be disadvantageously applied to the outer surface of the sleeve 3.

Where the position where the sleeve 3 and metallic body 2 are secured varies within a range of about several tens of μm, the distance between the metallic body 2 and screen 15 will also vary. This leads to a variation in the printed thickness in the carbonate paste 16. For this reason, when the oxide cathode aligning/fixing jig 13 as shown in FIG. 3 is used, a large range of variation of ±30 μm in the thickness of the printed film will occur.

Figure 13:
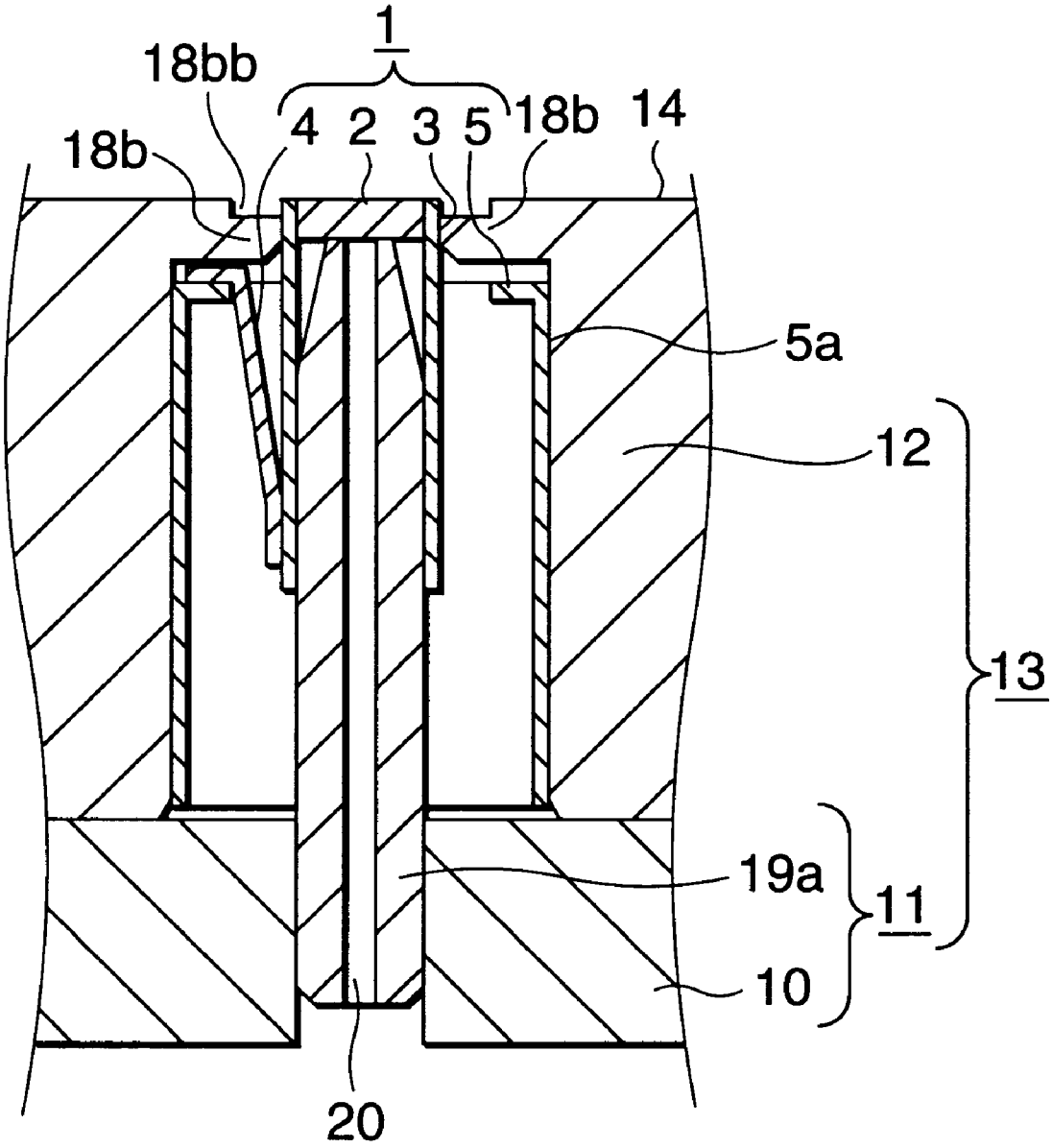
FIG. 13 is a schematic sectional view of the basic structure of an oxide cathode aligning/fixing jig according to the ninth embodiment of the present invention.

In this embodiment, referring to FIG. 13 showing a structural sectional view, an explanation will be given of an oxide cathode aligning/fixing jig capable of overcoming the above disadvantage.

Where the oxide cathode aligning/fixing jig 13 as shown in FIG. 13 is used, first, the member 19*a* for supporting the bottom of the metallic body and the internal surface of the sleeve is directly passed through the cylinder of the sleeve 3. This corrects the deformation "B" (if it is comparatively light) prevents misalignment in printing pattern with the screen.

Secondly, the bottom of the metallic body 2 is directly supported so that it is positioned in a vertical position. For this reason, the variation in position when the sleeve 3 and metallic body 2 are welded is not problematic. Meanwhile, since the weight of the hanging-type oxide cathode 1 is light, the member 19*a* for supporting the bottom of the metallic body and the internal surface of the sleeve may be entangled with the side of the eyelet 5 or the internal surface of the sleeve 3 by friction therebetween. Therefore, the member 19*a* may not be brought into contact with the bottom of the metallic body 2. In order to avoid such an undesired phenomenon, the air is swept through the sweeping hole 20 using a rotary pump for vacuum exhaustion to attract the metallic body 2.

The same technique as that described in connection with the first embodiment was adopted. Specifically, the fixing jig capable of aligning/securing 2500 hanging-type oxide cathodes and those hanging-type oxide cathodes 1 having been subjected to oxygen treatment were prepared. First, the 2500 hanging-type oxide cathodes are inserted into and secured to the members 19*a* each for supporting the bottom of the metallic body and the internal surface of the sleeve. The hanging-type oxide cathodes are caught by and covered with the eyelet side supporting member 12 so that the lower surface of the eyelet side supporting member 12 is brought into contact with the upper surface of the base member 11 serving as the lower fixing jig.

The cutting hole 5*a* is formed in the eyelet side supporting member 12 serving as the upper fixing jig to provide a slight expansion having an increased opening diameter in the vicinity of the lower surface so that the oxide cathode 1 can be easily caught by the eyelet side supporting member 12.

While the air is swept from the upper end of the sweeping hole 20 through the sweeping hole 20 using a rotary pump for vacuum exhaustion, as shown in FIG. 5 of the first embodiment, the carbonate paste 16 is printed on the upper surface of the metallic body 2 and dried.

As a result of having measured the thickness of the carbonate layer 16 after printing/drying, it is confirmed that the carbonate paste could be applied at the precision of 70±10 μm with respect to a target value of 70 μm. Misalignment of the printed pattern and application of the carbonate paste 16 on the outer surface of the sleeve 3 did not occur.

What is claimed is:

1. An oxide cathode aligning/fixing jig in which a plurality of oxide cathodes, each having a metallic body on an upper surface of which a screen-printing layer is to be applied, are aligned/fixed at regular intervals in a state where the upper surface of the metallic body is oriented upward.

2. An oxide cathode aligning/fixing jig according to claim 1, wherein the upper surfaces of the metallic bodies are made flush with one another.

3. An oxide cathode aligning/fixing jig according to claim 2, wherein each of said oxide cathodes is fixed at its bottom.

4. An oxide cathode aligning/fixing jig according to claim 3, wherein each of said oxide cathode is fixed at its side.

5. An oxide cathode aligning/fixing jig according to claim 1, wherein said plurality of oxide cathodes each includes a metallic body on an upper surface of which an electron radiative material layer is to be formed by screen-printing.

6. An oxide cathode aligning/fixing jig according to claim 1, wherein said plurality of oxide cathodes each includes a metallic body on an upper surface of which a carbonate layer is to be formed by screen-printing.

7. An oxide cathode aligning/fixing jig according to claim 6, wherein the upper surfaces of the metallic bodies are flush with one another.

8. An oxide cathode aligning fixing jig according to claim 1, wherein each said oxide cathodes is a hanging-type oxide cathode including a cylindrical sleeve at one end of which the metallic body is secured and an eyelet which surrounds a portion of the outer surface inclusive of the other end of said sleeve so as to protrude the metallic body and fixedly hangs said sleeve through a ribbon; and wherein said oxide cathode aligning/fixing jig includes a plate-like upper fixing jig which have through-holes formed at regular intervals and fixedly supports the outer surface of said eyelet, the diameter of each said through-holes corresponding to the diameter of the eyelet; and a plate-like lower fixing jig which has sleeve bottom supporting members arranged to correspond to said through-holes in their position and fixedly supports the bottom of said sleeve, each said sleeve bottom supporting members being a cylinder having a diameter smaller than that of the eyelet and larger than that of said sleeve.

9. An oxide cathode aligning fixing jig according to claim 8, wherein each said oxide cathodes is a hanging-type oxide cathode including a cylindrical sleeve at one end of which the metallic body is secured and an eyelet which surrounds a portion of the outer surface inclusive of the other end of said sleeve so as to protrude the metallic body and fixedly hangs said sleeve through a ribbon; and wherein said oxide cathode aligning/fixing jig includes a plate-like upper fixing jig which have through-holes formed at regular intervals and fixedly supports the outer surface of said eyelet, the diameter of each said holes corresponding to the diameter of the eyelet; and a lower fixing jig having cylinders each of which is structured to support the bottom of each said metallic bodies and internal surface of said sleeve, and has an end surface in contact with the bottom of each said metallic bodies having a smaller diameter than that of the other end surface.

10. An oxide cathode aligning/fixing jig according to claim 8, wherein said sleeve bottom supporting members or cylinders of said lower fixing jig each has a sweeping hole at a position in contact with the bottom of said sleeve or metallic body.

11. An oxide cathode aligning/fixing jig according to claim 8, wherein said upper fixing jig is structured to protrude toward the center of the through-hole so that each said through-holes of said upper fixing jig has a smaller diameter at a portion in the vicinity of the metallic body when said oxide cathode is installed than the remaining portion, thereby constituting a sleeve side supporting member.

12. An oxide cathode aligning/fixing jig according to claim 11, wherein a depression is formed on the upper surface of said fixing jig corresponding to the end of said sleeve side supporting member, or a taper is formed downward toward the end of said sleeve side supporting member.

13. An oxide cathode aligning/fixing jig according to claim 12, wherein said depression or taper has a size enough to prevent paste layer formed by screen-film printing from being applied to the side of said sleeve by the capillary action.

14. An oxide cathode aligning/fixing jig according to claim 11, wherein said sleeve side supporting member is formed to provide a minute gap between itself and the sleeve when said oxide cathode is installed.

15. An oxide cathode aligning/fixing jig according to claim 14, wherein said minute gap has a size enough to prevent paste layer formed by screen-printing from being applied to the side of said sleeve by the capillary action.

16. An oxide cathode aligning/fixing jig according to claim 8, wherein the upper surface of said upper fixing jig is flush with that of said metallic body when each said oxide cathodes is arranged.

17. An oxide aligning/fixing jig according to claim 1, wherein each said oxide cathodes is composed of a metallic body and a sleeve with said metallic body secured to its one end, wherein said oxide cathode aligning/fixing jig includes a plate-like upper fixing jig which have through-holes formed at regular intervals and fixedly supports the outer surface of said eyelet, the diameter of each said through-holes corresponding to the maximum diameter of said sleeve; and a plate-like lower fixing jig which has cylinders arranged to correspond to said through-holes in their position and fixedly supports the bottom of said metallic body and the internal surface of said sleeve.

18. A method of fabricating a plurality of oxide cathodes with a carbonate layer applied thereon using the oxide cathode aligning fixing jig according to claim 8, comprising the steps of:

aligning and fixing said plurality of the metallic body for the oxide cathodes in said aligning/fixing jig so as to expose the upper surface of said metallic body;

screen-printing carbonate paste on the upper surface of said metallic body by screen printing; and drying and baking said plurality of oxide cathodes.

* * * * *